United States Patent [19]

Chen

[11] Patent Number: 4,708,684

[45] Date of Patent: Nov. 24, 1987

[54] TOY BUILDING BLOCK SET

[76] Inventor: Chen-Tsung Chen, No. 16, Alley 2, La. 7, Feng-Tung Rd., Fengyuan City, Taichung Hsien, Taiwan

[21] Appl. No.: 895,863

[22] Filed: Aug. 12, 1986

[51] Int. Cl.[4] ..... A63H 33/08

[52] U.S. Cl. ..... 446/127; 446/124

[58] Field of Search ..... 446/127, 124, 116, 114, 446/125, 95, 128; 312/111; 108/64

[56] References Cited

U.S. PATENT DOCUMENTS

| | | | |
|---|---|---|---|
| D. 254,606 | 4/1980 | Abelson | 63/15.1 |
| 1,257,097 | 2/1918 | Morris | 108/64 |
| 2,786,301 | 3/1957 | Torricelli | 446/124 |
| 3,310,906 | 3/1967 | Glukes | 446/95 |
| 3,420,275 | 1/1969 | Glen et al. | 446/124 |
| 3,456,413 | 7/1969 | Fischer | 446/125 |
| 3,974,898 | 8/1976 | Tullis et al. | 312/111 |
| 4,556,394 | 12/1985 | Chen | 446/124 |

FOREIGN PATENT DOCUMENTS

| | | | |
|---|---|---|---|
| 427207 | 6/1967 | Switzerland | 446/127 |

*Primary Examiner*—Victor N. Sakran

*Attorney, Agent, or Firm*—Holman & Stern

[57] ABSTRACT

A toy building block set having several kinds of blocks, each of them including a circular member on the outer circumference of which a plurality of connecting elements and sockets are provided whereby the block sets are capable of being developed into a variety of articles through connecting selective blocks at selected relative positions, and assembling with an inflatable member to enable the finished work to float on the surface of the water.

4 Claims, 11 Drawing Figures

TOY BUILDING BLOCK SET

BACKGROUND OF THE INVENTION

This invention relates to a plastic toy building block set, particularly to a set of building blocks which can be connected with similar blocks in more than one direction to develop into the finished house or other articles capable of floating on the water.

U.S. Pat. No. 4,556,394 provides a set of building blocks each of which has a rectilinear outline to assemble into articles in desired shapes or to even combine with inflatable members so as to assemble into floating articles. However, the building blocks of U.S. Pat. No. 4,556,394 is complicated in structure, great in weight and troublesome in assembly.

To obviate the above disclosed defects, one object of this invention is to provide a toy building block set each circular member of which is light whereby the assembled article may even float in the air.

Another object of this invention is to provided a toy building block set which is simpler in structure whereby this invention is easy to manufacture as a result of which the cost is cut down, and easy to assemble.

The invention itself, together with additional objects and advantages thereof, will be best understood from the following description of specific embodiment when read in connection with the accompanying drawings, in which the like numerals indicates the same members.

Figure 11:
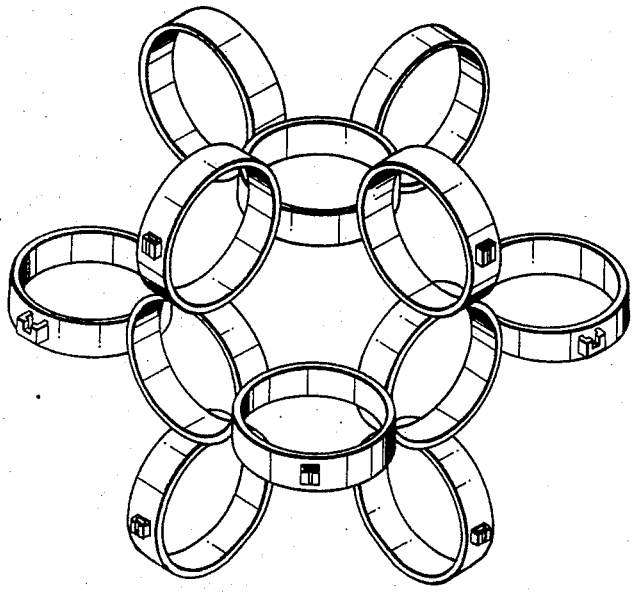

FIG, 10 is a perspective view of still another finished article through assembling of the blocks and inflatable members;

FIG. 11 is a perspective view of a further finished article through assembling of the blocks.

DETAILED DESCRIPTION OF THE PREFERRED EMBODIMENTS OF THIS INVENTION

Figure 1:
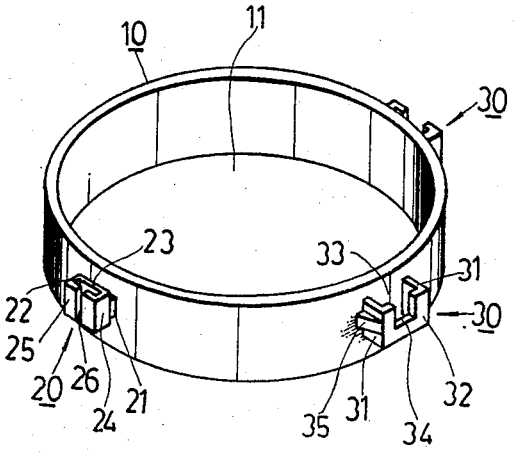
FIG. 1 is a perspective view of the first building block according to a preferred embodiment of this invention.

Referring now to FIG. 1, the first building block made of plastic comprises a cylindrical circular member 10 along the outer circumference of which integrally extends a connecting element 20 and two socket 30. The connecting element 20 comprises a neck portion 21 on the outer circumference of the circular member 10 and a head portion 22 adjacent to the neck portion 21. The head portion 22 includes a rear wall 23 on the neck portion 21, two side walls 24 contiguous with said rear wall 23 and a front wall 25 extending between said side walls 24. On the front wall 25 there is provided a longitudinal slit 26. The socket 30 having two side walls 31 contiguous with the outer circumference of the circular member 10, a front wall 32 extending between said side walls 31 and two reinforcing ribs 35 respectively extending between the outer intersecting corners of the side walls 31 and the outer circumference of the circular member 10. The front wall 32 of the socket 30 is provided a indentation 34 and, the side walls 31, the front wall 32 and the outer circumference of the circular frame 10 combine to define a receiving space 33.

Figure 2:
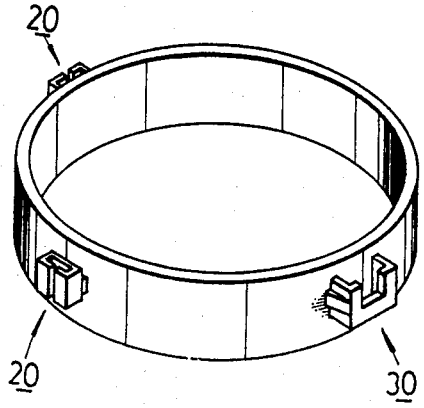
FIG. 2 is a perspective view of the second building block according to a preferred embodiment of this invention.
Figure 3:
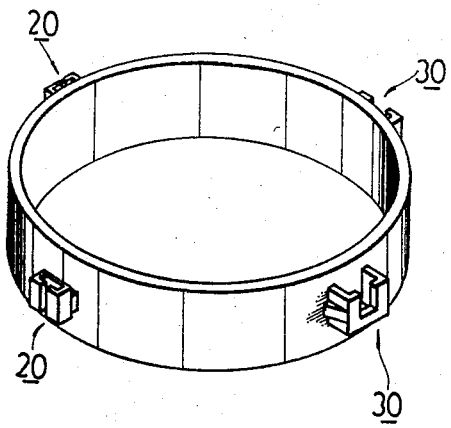
FIG. 3 is a perspective view of the third building block according to a preferred embodiment of this invention.
Figure 4:
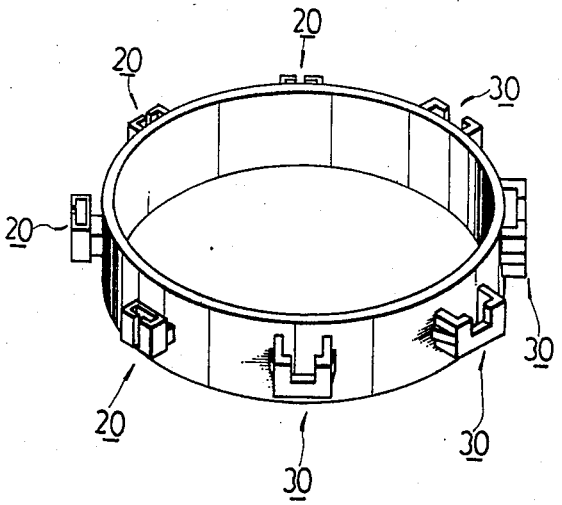
FIG. 4 is a perspective view of the fourth building block according to a preferred embodiment of this invention.

Further as shown in FIGS. 2, 3 & 4, the second building block comprises two connecting elements 20 and one socket 30 and the third building block comprises two connecting elements 20 and two sockets 30 while the fourth building block comprises four connecting elements 20 and four sockets 30. The connecting element 20 and socket 30 respectively provided on the second, third and fourth building block are approximately the same as those provided on the first building block.

Figure 5:
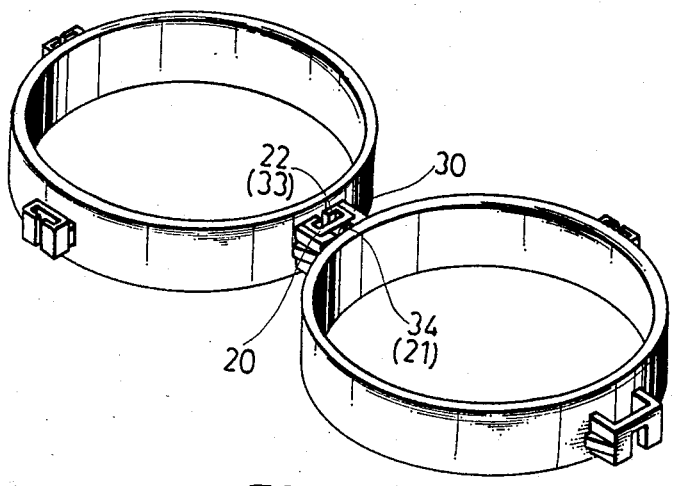
FIG. 5 is a view of two building blocks connected in a horizontal position.
Figure 6:
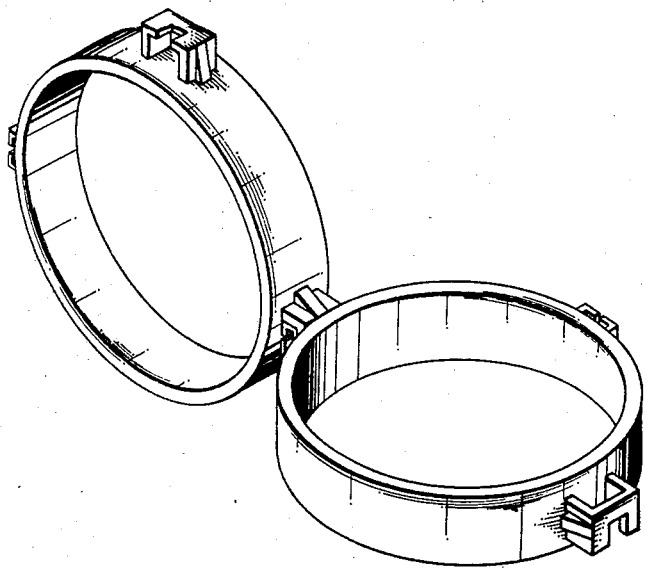
FIG. 6 is a view of two building blocks connected in an intersecting position.

For the socket 30 of each building block is applied to receive the connecting element 20 thereof in a horizontal or intersecting position, the neck portion 21 head portion 22 of the connecting element 20 defines a rectangular section. Furthermore, the neck 21 equals to the indentation 34 which is provided on the socket in width, however, is smaller in length whereby the outer dimension of the head portion 22 is corresponding to the inner dimension of the socket 30. As shown in FIG. 5, the head portion 22 of a connecting element 20 which is provided on a building block is received within the receiving space 33 of a socket 30 which is provided on another building block in a horizontal position wherein the neck portion 21 extends into the indentation 34. However as shown in FIG. 6, for the neck portion 21 and head portion 22 of the connecting element 20 define a rectangular section, one building block may intersect, i.e., be disposed at right angles to, another one in a perpendicular position.

Figure 7:
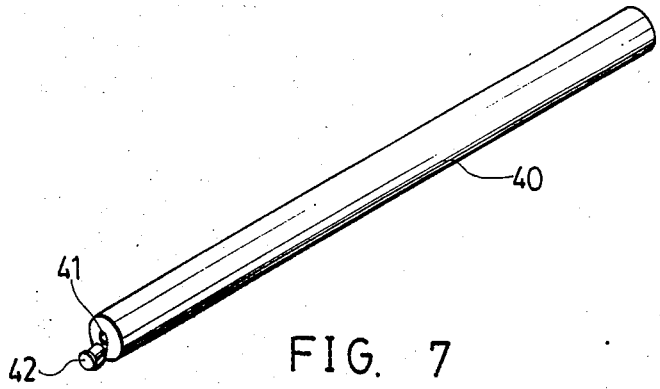
FIG. 7 is a perspective view of an inflatable member according to a preferred embodiment of this invention.

As referred in FIG. 7, a tube inflatable member 40 made of plastic film with a thin thickness is provided thereon an inflating hole 41 and a removable stopper 42. The inflatable member 40 extends partially into a circular member 10 and then is inflated. The inflatable member after being inflated will expand to tightly engage to the circular member 10.

Figure 8:
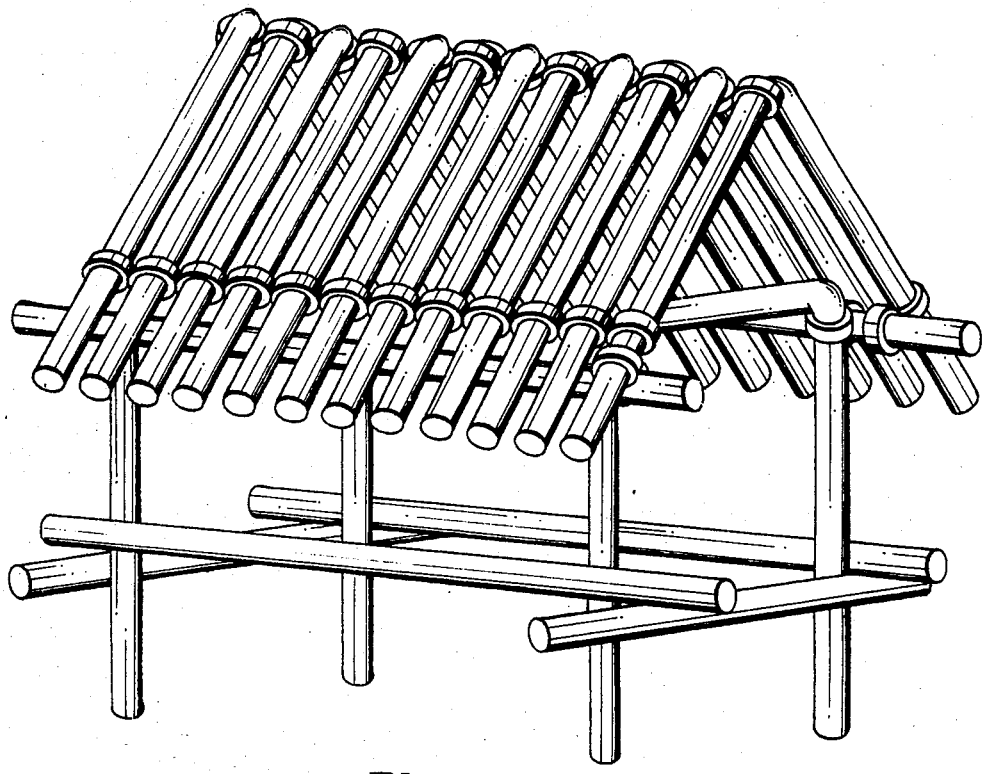
FIG. 8 is a perspective view of a finished article through assembling of the blocks and inflatable members.
Figure 9:
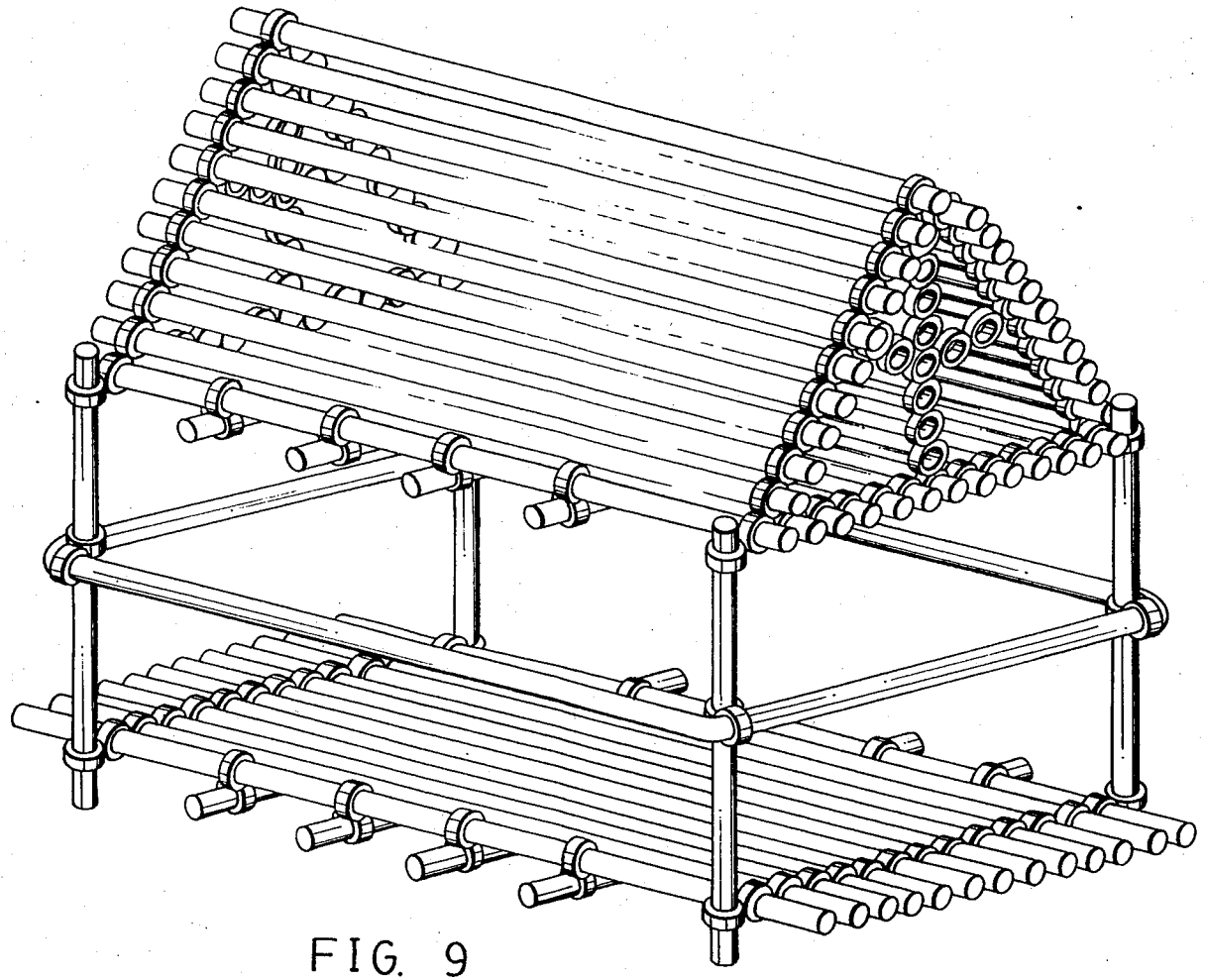
FIG. 9 is a perspective view of another finished article through assembling of the blocks and inflatable members.
Figure 10:
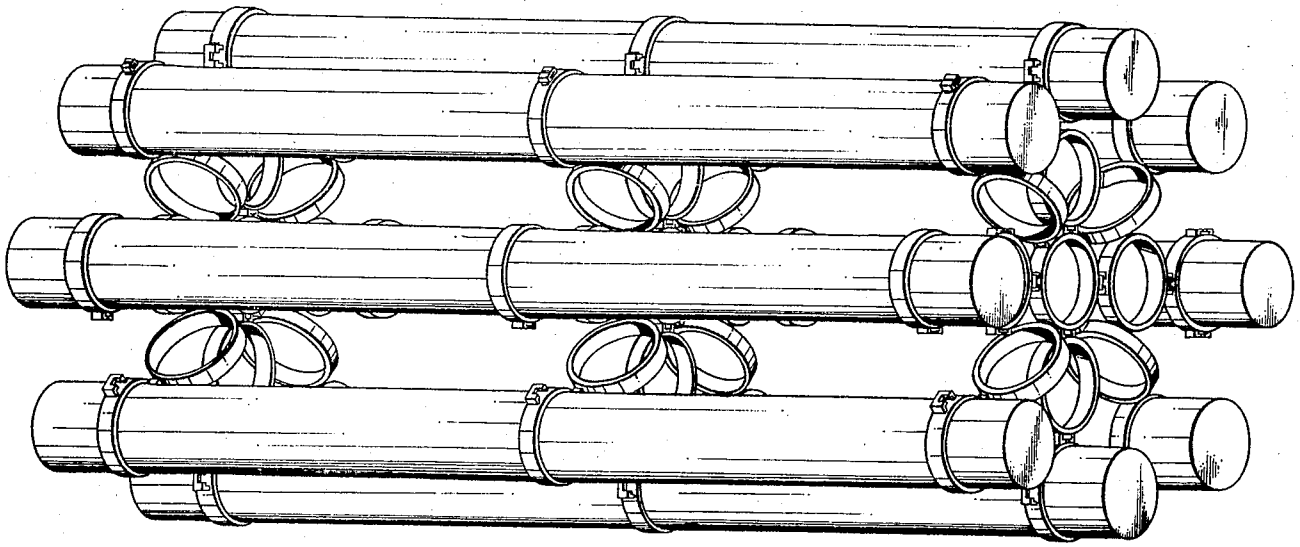

With the circular member 10 of each design and the inflatable member 40 as basic blocks, this invention may be selectively developed into a desired shape samples of which are as shown in FIGS. 8, 9, 10 & 11. Wherein FIGS. 8 & 9 shows two house-like finished works. The house-like finished works as shown in FIGS. 8 & 9 are assembled in a way that first the circular frames 10 of each design are first intersected, then, the inflatable members 40 before inflating respectively extend through the circular frames 10, and finally, the inflatable members 40 are inflated. The finished work as shown in FIG. 10 is assembled by first intersecting the circular frames 10 of each design into three identical madels and then connecting the three identical models by means of the inflatable members 40. The finished work as shown in FIG. 11 is assembled by intersecting the circular frames 10 of each design into a ball shaped model.

While the invention has been described in connection with what is presently considered to be the most practical and prefered embodiments, it is to be understood that the invention, is not to be limited to the disclosed embodiment, but on the contrary, is intended to cover various modifications and equivalent arrangements included whithin the spirit and scope of the appended claims the scope of which is to be accorded the broadest interpretation so as to encompass all such modifications and equivalent structures.

What I claim:

1. A toy building block system adapted for assembly to form a variety of configurations through connecting a plurality of blocks and inflatable members, comprising:

a plurality of blocks and a plurality of inflatable members; each one of said plurality of blocks including a generally cylindrical body adapted to receive a portion of one of said plurality of inflatable members;

each said one of said plurality of blocks having an outer circumference having a plurality of connecting elements and sockets;

ones of said connecting elements including a neck portion and a head portion connected to said neck portion;

ones of said sockets having two side walls contiguous with said outer circumference of said generally cylindrical body, a front wall extending between said two side walls, and an indentation in said front wall;

said indentation being adapted to receive a head portion of a connecting element of another one of said blocks in either of two orientations which are at generally right angles to one another;

ones of said inflatable members passing through at least two of said generally cylindrical bodies in supporting engagement therewith to enable a plurality of blocks to be connected to form an assembly including ones of said inflatable members so as to increase the buoyancy of an assembly formed thereby.

2. A toy building block system as claimed in claim 1 wherein said head portion of said connecting element comprises a rear wall adjacent to said neck portion, two side walls contiguous with said rear wall, a front wall extending between said side walls of said connecting element and a slit on said front wall of said connecting element.

3. A toy building block system as claimed in claim 2 wherein said head portion and neck portion of said connecting element are of rectangular section.

4. A toy building block system as claimed in claim 1 wherein at least four different types of said blocks are included, a first type of block having one connecting element and two sockets; a second type of block having two connecting elements and one socket; a third type of block having two connecting elements and two sockets; and a fourth type of block having four connecting elements and four sockets.

* * * * *